US007681397B2

(12) United States Patent
Assaf

(10) Patent No.: US 7,681,397 B2
(45) Date of Patent: Mar. 23, 2010

(54) HEAT ENGINE

(75) Inventor: Gad Assaf, Beer Sheva (IL)

(73) Assignee: Agam Energy Systems, Ltd., Hod Hasharon (IL)

( * ) Notice: Subject to any disclaimer, the term of this patent is extended or adjusted under 35 U.S.C. 154(b) by 505 days.

(21) Appl. No.: 11/658,721

(22) PCT Filed: Jul. 28, 2005

(86) PCT No.: PCT/IL2005/000807

§ 371 (c)(1),
(2), (4) Date: Jan. 29, 2007

(87) PCT Pub. No.: WO2006/011150

PCT Pub. Date: Feb. 2, 2006

(65) Prior Publication Data

US 2008/0314041 A1 Dec. 25, 2008

(30) Foreign Application Priority Data

Jul. 29, 2004 (IL) ..... 163263

(51) Int. Cl.
*F04C 19/00* (2006.01)

(52) U.S. Cl. ..... 60/726; 417/68

(58) Field of Classification Search ..... 60/726, 60/39.54; 417/68, 69, 70, 65, 66; 123/204, 123/234, 241
See application file for complete search history.

(56) References Cited

U.S. PATENT DOCUMENTS

| | | | | |
|---|---|---|---|---|
| 1,094,919 A | | 4/1914 | Nash | |
| 3,102,083 A | * | 8/1963 | Adams | 203/11 |
| 3,395,854 A | * | 8/1968 | Martin et al. | 417/54 |
| 3,484,038 A | * | 12/1969 | Martin | 91/54 |
| 4,112,688 A | | 9/1978 | Shaw | |
| 4,984,432 A | | 1/1991 | Corey | |
| 5,251,593 A | | 10/1993 | Pedersen | |

FOREIGN PATENT DOCUMENTS

| | | |
|---|---|---|
| CN | 1058550 A | 2/1992 |
| CN | 1143052 A | 2/1997 |
| DE | 3408633 A1 | 9/1985 |
| EP | 0 804 687 | 7/1996 |
| JP | 2001152871 A | 6/2001 |

OTHER PUBLICATIONS

Chinese Office Action dated Jul. 24, 2009.

* cited by examiner

*Primary Examiner*—Michael Cuff
*Assistant Examiner*—Vikansha S Dwivedi
(74) *Attorney, Agent, or Firm*—Bachman & LaPointe, P.C.

(57) ABSTRACT

A heat engine, includes at least one Liquid Ring Rotating Casing Compressor (LRRCC) having a fluid inlet and a fluid outlet, a combustion chamber in fluid communication with the output of the LRRCC, and at least one expander having a fluid inlet and a fluid outlet. The fluid inlet communicates with the combustion chamber.

13 Claims, 2 Drawing Sheets

HEAT ENGINE

FIELD OF THE INVENTION

The present invention relates to heat engines and more particularly to Liquid Ring Rotating Casing Compressor (LRRCC) heat engines.

BACKGROUND OF THE INVENTION

Heat engines usually use piston drives and crankshafts to convert linear motion to rotating motion. There were many attempts to convert gas turbines, which dominate the aviation industry, into a compact vehicle engine. In these attempts, the small turbine rotate at rpm or so, which requires expensive transmission or electric power generation that reduces shaft work efficiency.

Liquid ring machinery are simple, reliable and low noise compressors and vacuum pumps, which convert the shaft work to radial compression without utilizing pistons and crankshafts. Analysis of the different components of shaft work in liquid ring compressors indicate that close to about 50% dissipate at the Liquid Ring-Casing boundary. With the LRRCC, the boundary friction is replaced by frictional bearing, which is less than 10% of the liquid ring dissipation. This makes the LRRCC a competitive partner in the compressor's and the expander's machinery.

Efficient LRRCC compressors/turbines are known from European Patent number 0,804,687, the teachings of which are herein incorporated by reference.

SUMMARY OF THE INVENTION

It is an object of the present invention to provide a most efficient heat engine based on LRRCC compressors/expanders.

In accordance with the invention, there is therefore provided a heat engine, comprising at least one Liquid Ring Rotating Casing Compressor (LRRCC) having a fluid inlet and a fluid outlet; a combustion chamber in fluid communication with the output of said LRRCC, and at least one expander having a fluid inlet and a fluid outlet, said fluid inlet communicating with said combustion chamber.

BRIEF DESCRIPTION OF THE DRAWINGS

The invention will now be described in connection with certain preferred embodiments with reference to the following illustrative figures, so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is a schematic representation of a heat engine according to the present invention;

FIG. 2 is a thermodynamic diagram of the LRRCC heat engine of a common design and according to the present invention, and FIG. 3 is a cross-sectional view of a preferred embodiment of the heat engine of FIG. 1.

DETAILED DESCRIPTION OF PREFERRED EMBODIMENTS

Figure 1:
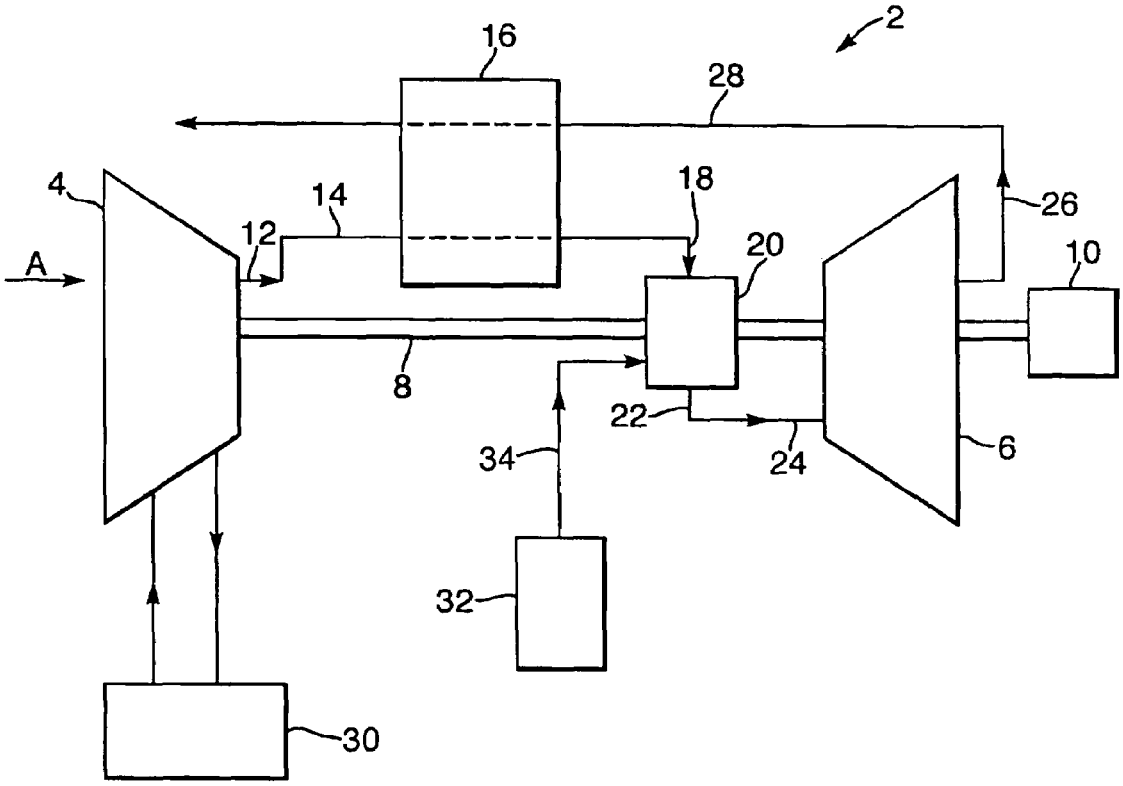

There is illustrated in FIG. 1 a heat engine 2, according to the present invention, including a LRRCC 4, and an expander 6, e.g., a turbine. The LRRCC 4 and expander 6 are mechanically mounted on the same shaft 8, as shown in this embodiment, or on a different shaft. When the expander 6 rotates at different speeds, transmission 10, e.g., a mechanical transmission (gears) or an electrical power transmission is coupled on the shaft 8. Thermodynamically, the output 12 from the LRRCC 4 leads via duct 14 through a heat exchanger 16 to the input 18 of a combustion chamber 20, for producing, e.g., a liquid or gas fuel-based combustion. The output 22 from the combustion chamber 20 leads to the input 24 of the expander 6. The output 26 from the expander 6 leads via a duct 28 through the heat exchanger 16 to the atmosphere. There is also provided a further heat exchanger 30 for cooling the LRRCC 4 and a fuel reservoir 32 feeding the combustion chamber 20 via duct 34.

As taught by the European Patent 0,804,687, the compressor 4 and/or expander 6, having a rotor core and a jacket and the eccentricity of the jacket mounted on said rotor core is given by: $e \leqq (1-c)/3$, where c is the ratio between the radius C of the core, and the radius R of the jacket $c=C/R$.

Figure 2:
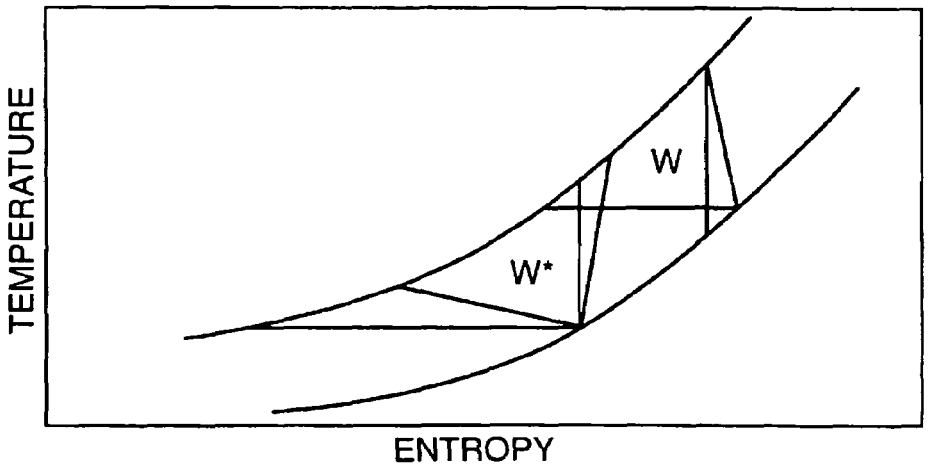

The operation of the heat engine is as follows: fluid is introduced (see Arrow A) into the LRRCC 4, is compressed therein and passed through the combustion chamber 20 where it is heated, to the expander 6. The heated residual fluid expelled from the output 26 of the expander is optionally passed through the heat exchanger 16, advantageously utilized to heat the output fluid of the LRRCC 4, before entering the combustion chamber 20 for further heating. As can be seen in FIG. 2, while useful work obtained by conventional gas turbines is represented by the area W, the useful work obtained by utilizing the heat engine according to the present invention is W+W*.

Figure 3:
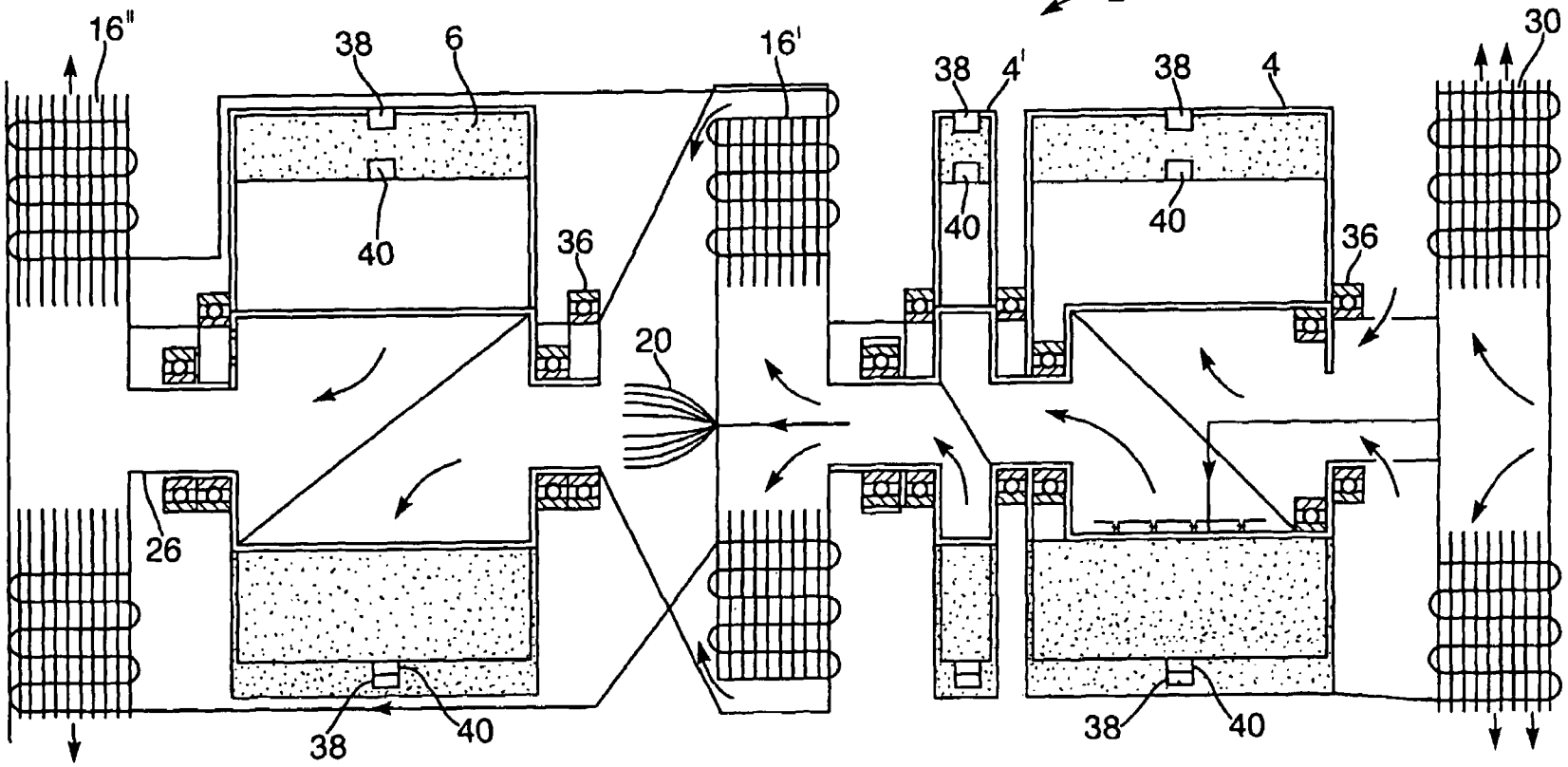

Referring to FIG. 3, there is depicted a cross-sectional representation schematically showing an actual arrangement of a multi-stage heat engine 2. Seen is a first stage LRRCC 4 and a second stage LRRCC 4', coupled to the first stage, and a heat exchanger 30 cooling the LRRCC 4. The output from the second stage LRRCC 4' is in fluid communication with first portion 16' of the heat exchanger 16, the output of which leads to the expander 6. Similar to the configuration of the LRRCC4 there may be provided a second expander (not shown) following the first one. A second portion 16" of the heat exchanger 16 is connected to the output of the expander 6. The combustion chamber 20 is schematically shown. Also depicted are the bearings 36 about which the compressors 4, 4', the expander 6 and other associated members, such as the heat exchanger rotate, as per-se known, and gears 38, 40 for rotating the casings of the compressors 4, 4' and expander 6. The gears 38, 40 are seen to be separated in the upper side of the heat engine 2, while being engaged in the lower side due, of course, to the eccentricity of the compressors and expander.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A heat engine, comprising:

at least one Liquid Ring Rotating Casing Compressor (LRRCC) having a jacket adapted to rotate eccentrically around a rotor core, a fluid inlet and a fluid outlet;

a combustion chamber in fluid communication with an output of said at least one LRRCC, and at least one expander having a fluid inlet and a fluid outlet, said fluid inlet of said at least one expander communicating with said combustion chamber;

wherein:

the jacket of the at least one LRRCC is articulated to the at least one expander so that the rotation of the at least one expander induces rotation for the LRRCC, the jacket is articulated to the rotor core via a mechanical transmission so that rotation of the jacket of the at least one LRRCC by the at least one expander induces rotation of the rotor core of the LRRCC, and a first heat exchanger is mechanically coupled by bearings to said jacket so as to rotate therewith and allow fluid communications between an output of the at least one LRRCC and the first heat exchanger for receiving water heated by the at least one LRRCC and returning cooled water for injection into the at least one LRRCC so as to maintain the at least one LRRCC isothermal.

2. The heat engine as claimed in claim 1, wherein said at least one expander is a turbine.

3. The heat engine as claimed in claim 1, wherein said at least one expander is a liquid ring turbine.

4. The heat engine as claimed in claim 3, wherein said turbine is a liquid ring rotating casing turbine.

5. The heat engine as claimed in claim 1, further comprising a second heat exchanger thermodynamically located between the output of said at least one LRRCC for directing fluid to said combustion chamber to be heated prior to propelling the fluid into said combustion chamber, and the output from said at least one expander for receiving the residual heat of the fluid ejected from said expander.

6. The heat engine as claimed in claim 1, wherein the first heat exchanger is configured for injecting cold water into the rotor core for cooling said LRRCC.

7. The heat engine as claimed in claim 1, wherein each of said at least one LRRCC and said at least one expander having a rotor core and a jacket and the eccentricity of the jacket mounted on said rotor core is given by:

$$e \leqq (1-c)/3$$

where c is the ratio between the radius C of the core, and the radius R of the jacket c=C/R.

8. A heat engine as claimed in claim 1, comprising at least one further LRRCC operationally coupled to said compressor to form a multi-stage LRRCC heat engine.

9. The heat engine as claimed in claim 8, wherein said LRRCC and said expander are mounted on one or more shafts coupled to a mechanical or electrical power transmission.

10. The heat engine as claimed in claim 1, wherein said LRRCC and said expander are mounted on one or more shafts coupled to a mechanical or electrical power transmission.

11. The heat engine as claimed in claim 1, wherein said mechanical transmission comprises opposing pairs of gears.

12. The heat engine as claimed in claim 6, wherein said mechanical transmission comprises opposing pairs of gears.

13. The heat engine as claimed in claim 8, wherein said mechanical transmission comprises opposing pairs of gears.

* * * * *